United States Patent [19]

Verbickas et al.

[11] 4,270,377

[45] Jun. 2, 1981

[54] EIGHTEEN HIGH ROLLING MILL

[75] Inventors: Robert C. Verbickas, Wolcott; John W. Turley, Oxford, both of Conn.

[73] Assignee: T. Sendzimir, Inc., Waterbury, Conn.

[21] Appl. No.: 30,368

[22] Filed: Apr. 16, 1979

Related U.S. Application Data

[63] Continuation-in-part of Ser. No. 907,502, May 19, 1978, abandoned.

[51] Int. Cl.[3] ..... B21B 29/00

[52] U.S. Cl. ..... 72/242; 72/247

[58] Field of Search ..... 72/241–243, 72/247

[56] References Cited

U.S. PATENT DOCUMENTS

| | | | |
|---|---|---|---|
| 1,905,129 | 4/1933 | Biggert, Jr. et al. | 72/243 |
| 2,907,235 | 10/1959 | Marakami | 72/243 |
| 3,076,360 | 2/1963 | Sendzimir | 72/242 |
| 3,523,439 | 8/1970 | Leifeld et al. | 72/241 |
| 3,733,878 | 5/1973 | Anderson et al. | 72/241 |
| 3,803,886 | 4/1974 | Sterrett et al. | 72/8 |
| 3,818,743 | 6/1974 | Kajiwara et al. | 72/243 |
| 3,943,742 | 3/1976 | Kajiwara et al. | 72/247 |

*Primary Examiner*—Milton S. Mehr

*Attorney, Agent, or Firm*—Frost & Jacobs

[57] ABSTRACT

A new rolling mill configuration providing improved performance and lower cost than is possible for conventional four-high and six-high mills.

This mill configuration contains eighteen rolls and may be described as an improved six-high arrangement, the improvement being in the provision of side support assemblies for the work rolls, thus enabling smaller work roll diameters to be adopted than is possible with four-high or six-high mills, resulting in lower separating forces and thus a lighter and less expensive mill construction for a given duty.

5 Claims, 8 Drawing Figures

EIGHTEEN HIGH ROLLING MILL

CROSS REFERENCE TO RELATED APPLICATION

This application is a continuation-in-part of Ser. No. 907,502 filed May 19, 1978, now abandoned.

This application is related to copending applications Ser. No. 880,601 filed Feb. 23, 1978 and Ser. No. 006,804 filed Jan. 26, 1979.

BACKGROUND OF THE INVENTION

The object of this invention is to provide improvements in the construction of cold metal rolling mills, with the purposes of improving their productivity and the quality of their product, and reducing their cost.

Generally, on conventional four-high (1-1) and six-high (1-1-1) mills, it is not possible to reduce the work roll diameter below about one quarter of the strip width. This is because, on work roll driven mills, the work roll neck must be sufficiently big to transmit the required rolling torque. On intermediate or back-up roll driven mills, it is because rolling torque reaction forces and tension forces cause lateral flexure of the work roll body, which can overstress the roll or spoil the strip flatness if the work roll diameter is too small.

BRIEF SUMMARY OF THE INVENTION

The present invention consists of a novel eighteen-high roll arrangement which may also be described as an improved six-high mill arrangement, the improvement being the provision of two lateral support roll cluster assemblies for each work roll, enabling work roll diameters as small as ⅓ of the minimum diameters possible on conventional four-high and six-high mills to be adopted. The lateral support assemblies provide support over the whole length of said work rolls, this being necessary to prevent lateral flexure of said work rolls under the action of drive torque reaction and tension forces. In a mill according to the present invention, either the intermediate rolls or the back-up rolls will be driven.

DETAILED DESCRIPTION

Figure 1:
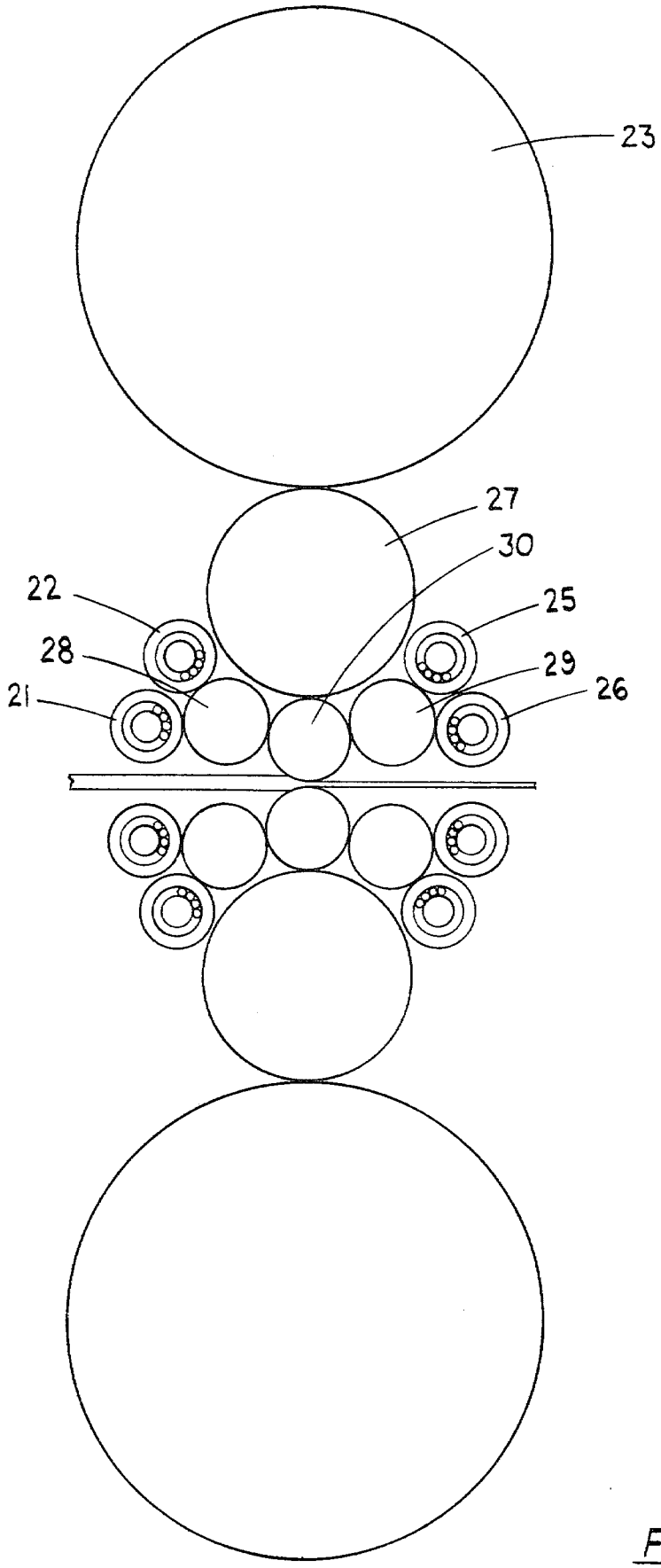
FIG. 1 is a diagrammatic front view of the eighteen-high roll arrangement according to the present invention.

The basic eighteen-high arrangement of FIG. 1 contains two clusters, each of said clusters consisting of work roll 30 supported vertically by intermediate roll 27 and back-up roll 23, and laterally by side intermediate rolls 28 and 29, which in turn are supported (both vertically and laterally) by side backing rollers 21, 22 and 25, 26, respectively.

Figure 2:
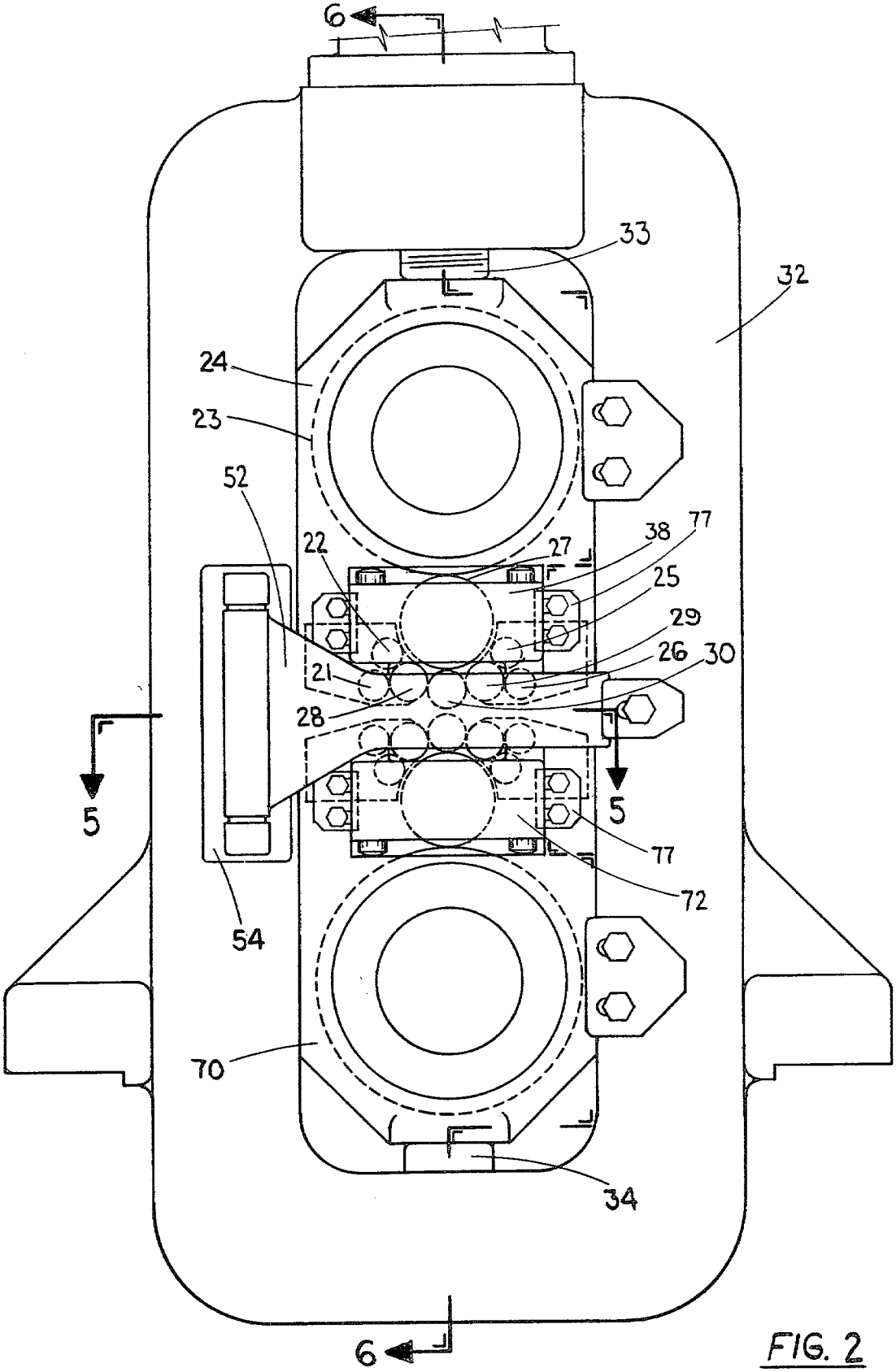
FIG. 2 is a front elevational view of one embodiment of the eighteen-high mill according to the present invention.

As shown in FIG. 2, the intermediate rolls are rotatably mounted in chocks 38 and the back-up rolls are rotatably mounted in chocks 24, the chocks being nested together and slidably mounted in the housing 32. Spacers 34 and screws 33 may be used to adjust the roll gap according to the prior art. Drive may be provided to either the back-up rolls or the intermediate rolls. The work rolls 30 are not mounted in chocks, but float freely in the stack as in cluster mills, and are restrained from sideways movement by the side support rolls 28 and 29, which are themselves fully supported by the side backing rollers 21 and 22, and 25 and 26, respectively.

Figure 3:
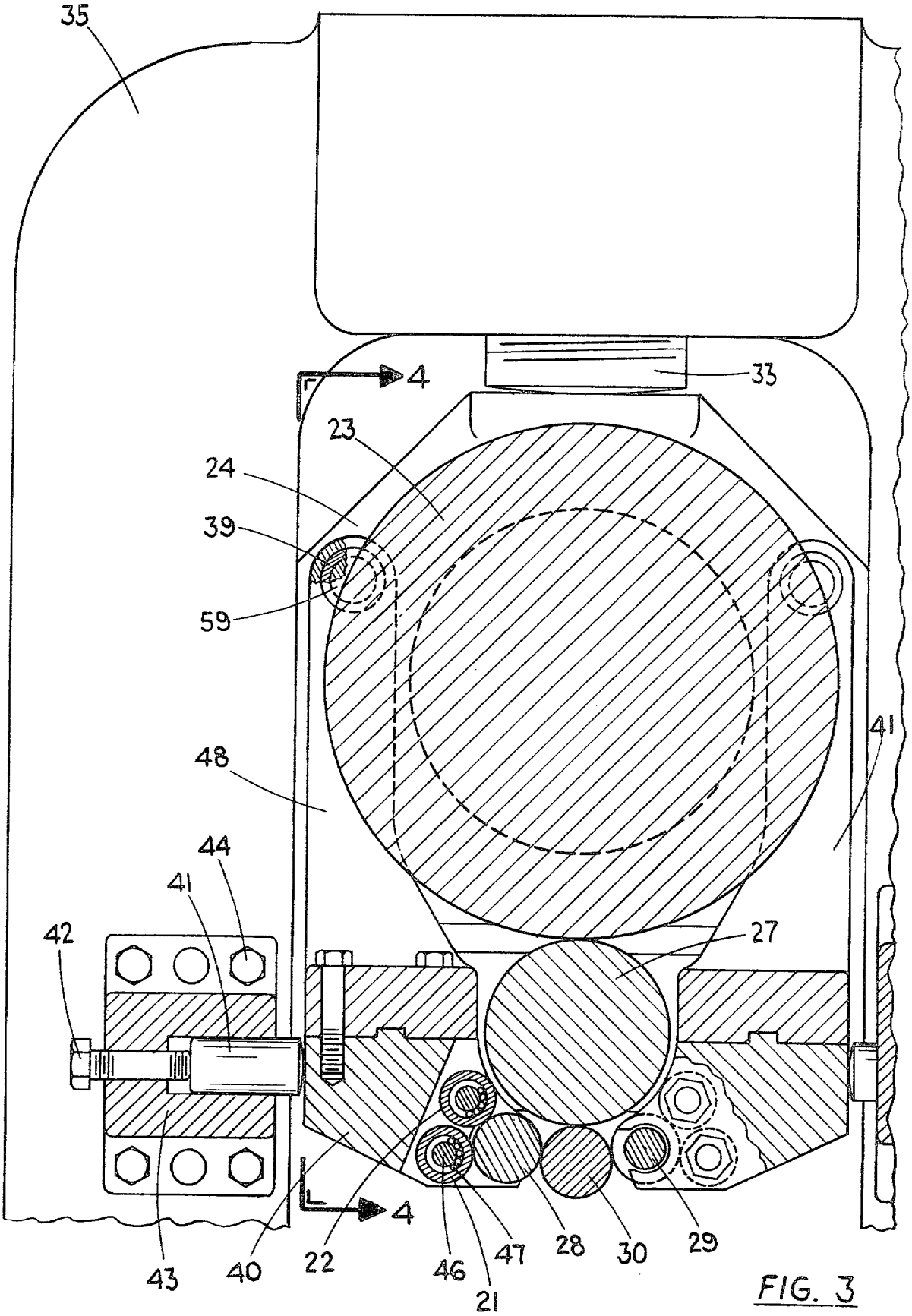
FIG. 3 is a front sectional elevation of the upper half of said embodiment showing mounting and adjustment of side support assemblies.
Figure 4:
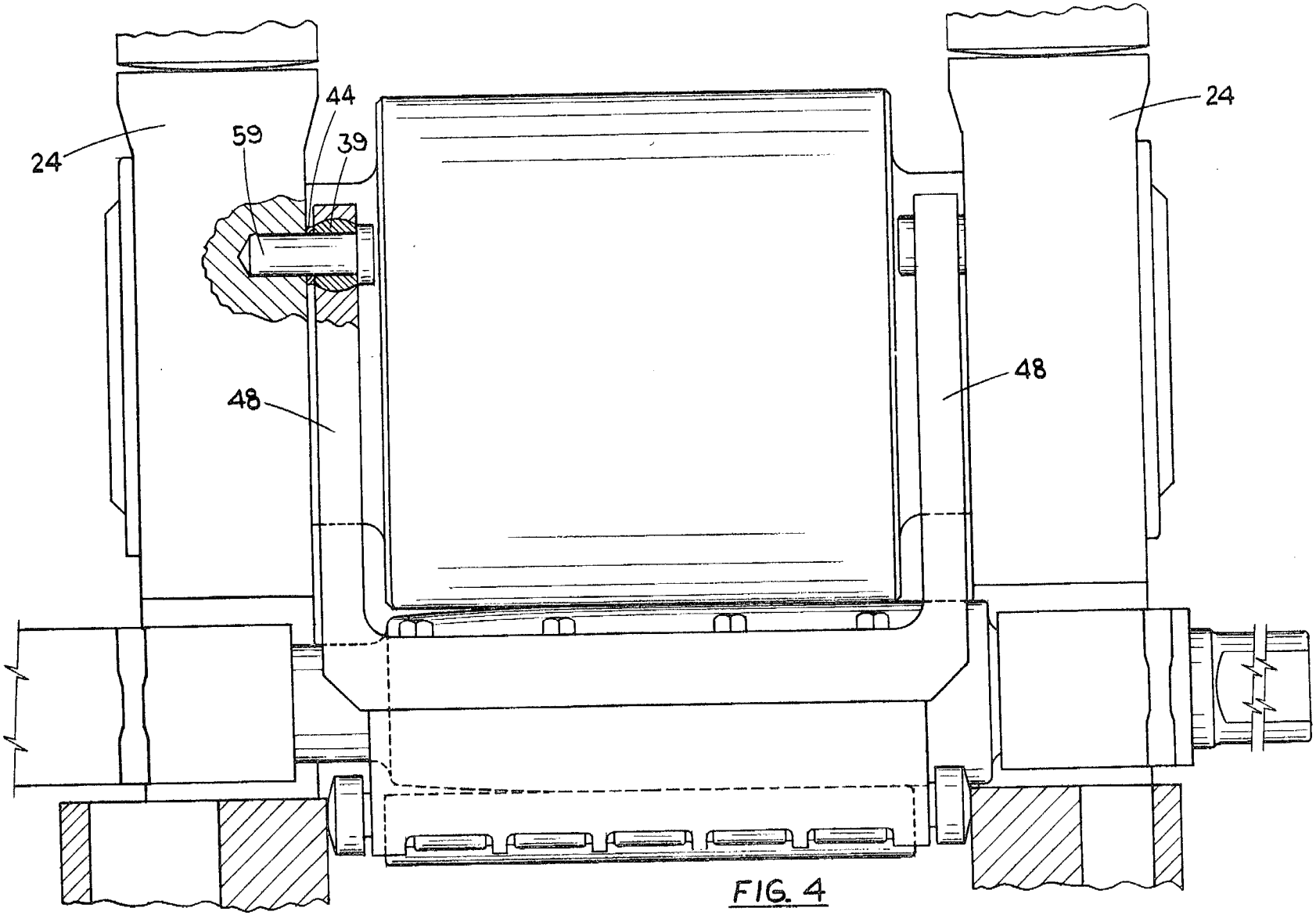
FIG. 4 is a view along the line 4—4 of FIG. 3.
Figure 5:
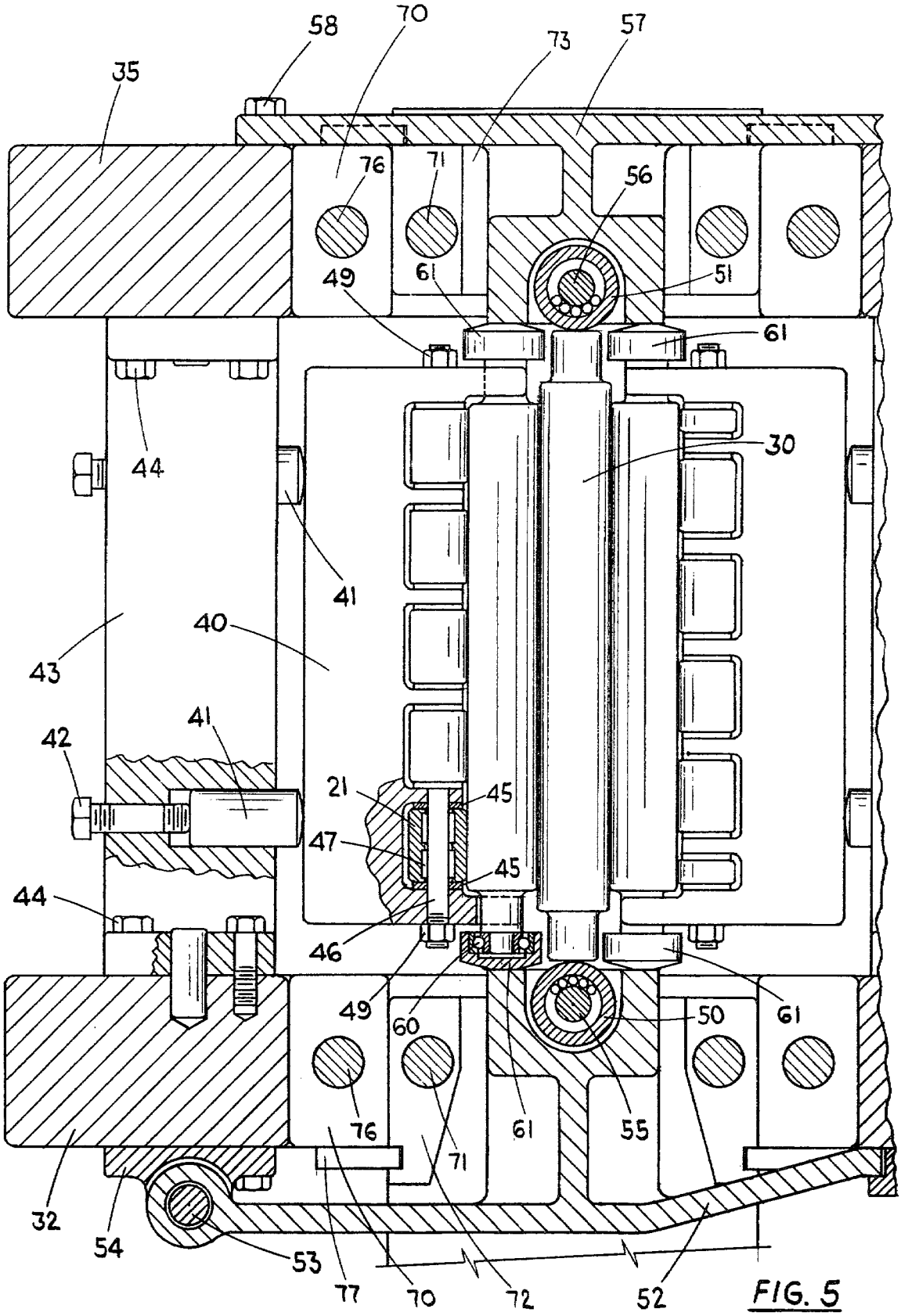
FIG. 5 is a plan sectional view along the line 5—5 of FIG. 2.

As shown in FIGS. 3 and 4, the backing rollers are mounted in side support beams 40 to which are attached the arms 48 which are pivoted on the back-up roll chocks 24 by means of pivot pins 59, bushings 39 and spacers 44. The work rolls are restrained axially by thrust rollers 50 and 51 mounted at each end as shown in FIG. 5. The front thrust roller 50 is mounted upon a stationary shaft 55 located in front door 52. The front door is hinge mounted on the front housing 32 by means of the pin 53 and bracket 54. The rear thrust roller 51 is mounted upon a stationary shaft 56 located in the back plate 57 which is attached to the rear housing 35 by means of bolts 58.

The side intermediate rolls 28 and 29 are retained axially by means of thrust bearings 60 and thrust buttons 61 mounted on each end of the side intermediate rolls. The thrust buttons bear against the front door 52 and against the back plate 57, thus preventing any axial movement of the side intermediate rolls.

The above described arrangement for axial support of work rolls and side intermediate rolls is according to the prior art for Sendzimir cluster mill rolls.

As shown in FIG. 3 and FIG. 5, a typical side backing roller 21 is rotatably mounted on a shaft 46 by means of needle rollers 47. The side backing rollers are mounted within recesses in the side support beams 40 to which they are rotatably mounted by means of shafts 46. Spacer washers 45 are used to locate the rollers centrally within the recesses in the side support beam, and the shafts 46 are clamped within the side support beams by nuts 49. Each of the side support beams is supported horizontally by rods 41 and vertically by pivot connection to back-up roll chocks 24 as described above. Spacer rods 41 are mounted in bores in the spacer beam 43 which is rigidly mounted to the front housing 32 and the rear housing 35 by means of bolts 44. Any lateral load on the side support beams is transmitted via rods 41 to adjusting screws 42 mounted in the spacer beams.

The construction of all four sets of side backing assemblies, and their support and adjustment mechanisms are similar and are as described above. This construction is, in some respects, similar to the construction of side backing assemblies incorporated in the cluster mill of copending application Ser. No. 880,601.

The embodiment described above is given by way of example only, and is not intended to limit the scope of the invention.

It will be noted that, in the embodiment described herein, the work rolls are fully supported throughout their length by the side intermediate rolls, and the side intermediate rolls are in turn fully supported in both horizontal and vertical planes by the side backing assemblies.

On the other hand, the intermediate and back-up rolls are chock mounted as on conventional four-high and six-high mills. Chock mounting is satisfactory for these larger rolls, but it is only the full support provided by the side intermediate rolls and side backing assemblies which allows a smaller work roll to be used than on conventional mills.

It is anticipated that mills according to the present invention may also combine features of both conventional four-high mill and cluster mill technology.

For example, construction of work roll and side support assemblies may follow Sendzimir cluster mill technology, but the intermediate and back-up roll and housing would follow conventional four-high mill technology. It is envisaged that other features of the mill may be according to prior art for either technology. Roll bite spray design will probably follow cluster mill technology. Drive arrangements, back-up roll and intermediate roll mounting, screwdown and roll change devices will probably follow four-high mill technology.

In many cases it will be possible to convert existing four-high and six-high mills to the new eighteen-high arrangement by replacing existing roll and chock assemblies with roll and chock assemblies according to the present invention, and mounting front door, back plate and spacer beams on the mill housings.

We will now show that, for a very wide range of materials, the mill of subject invention can give heavier reductions and roll to much lighter gauges than a four-high mill similar size. We will also show that, for the same reductions, a smaller and therefore less expensive installation can be adopted with a mill according to subject invention.

In co-pending application Ser. No. 006,804 of Jan. 26, 1979 some basic theoretical relationships are established for roughing passes as follows:

$$\delta(\max) = D2/100 \quad \text{(i)}$$

$$RSF = KD2/14.14 \quad \text{(ii)}$$

$$V = KD2/33{,}000 \quad \text{(iii)}$$

$$RSF/V = 2333 \quad \text{(iv)}$$

Equations (ii) to (iv) apply for a mill taking reduction δmax in a pass, with equal front and back tensions, where δ = H1 − H2 = entry gauge − exit gauge (in)

RSF = specific roll separating force (lb/in)

D2 = work roll diameter (in)

K = resistance to deformation (hardness) of strip being rolled (lb/sq.in)

V = specific rolling power/inch of strip width at 100 FPM (HP/100 FPM/in)

Furthermore, more generally during roughing passes, the following relationships were set down in said co-pending application.

$$RSF = K\sqrt{D2 \cdot \delta/2} \quad \text{(v)}$$

$$V = K \cdot \delta/330 \quad \text{(vi)}$$

Also some basic relationships for four-high mills were set down as follows.

$$W = D1 \quad \text{(vii)}$$

$$\text{Max. } RSF = 1500D1^2/W = 1500D1 \quad \text{(viii)}$$

$$D2 = D1/3 \quad \text{(ix)}$$

where

W = max. strip width (in)

D1 = back-up roll diameter (in)

These relationships were used to tabulate the basic capability of typical four-high mills as follows.

TABLE 1

| | | | | | | |
|---|---|---|---|---|---|---|
| Strip Width (in) | 72 | 60 | 48 | 36 | 24 | 18 |
| D1 in (vii) | 72 | 60 | 48 | 36 | 24 | 18 |
| D2 in (ix) | 24 | 20 | 16 | 12 | 8 | 6 |
| Max. RSF × 1000 lb/in (viii) | 108 | 90 | 72 | 54 | 36 | 27 |
| δ max (i) | .24 | .20 | .16 | .12 | .08 | .06 |
| Value of K (× 1000 lb/in²) for above δ max (ii) | 64 | → | → | → | → | → |

From our studies of work roll neck stresses on work roll driven four-high rolling mills, we have established that the following relationship can be used to establish the power transmitting capability of four-high mill work rolls.

$$U\max = 6\,D2^2 \quad \text{(x)}$$

where U max = max. useable rolling power at 100 FPM (HP/100 FPM) Table 1 can then be extended to establish the maximum reductions that can be taken by typical four-high mills for various material hardnesses.

TABLE 1 (continued)

| | | | | | | |
|---|---|---|---|---|---|---|
| Strip width in | 72 | 60 | 48 | 36 | 24 | 18 |
| U max (HP/100 FPM) (x) | 3456 | 2400 | 1536 | 864 | 384 | 216 |
| K = 64,000 lb/in² | | | | | | |
| δ max in (v) | .24 | .20 | .16 | .12 | .08 | .06 |
| V HP/100 FPM/in (vi) | 46.55 | 38.79 | 31.03 | 23.27 | 15.52 | 11.64 |
| U = V × W HP.100 FPM | 3351 | 2327 | 1489 | 838 | 372 | 209 |
| K = 100,000 lb/in² | | | | | | |
| δ max. in (v) | .097 | .081 | .065 | .049 | .032 | .024 |
| V Hp/100 FPM/in (vi) | 29.4 | 24.5 | 19.7 | 4.8 | 9.7 | 7.3 |
| U = V × W HP/100 FPM | 2116 | 1473 | 945 | 534 | 233 | 131 |
| K = 150,000 lb/in² | | | | | | |
| δ max. in (v) | .043 | .036 | .029 | .022 | .014 | .011 |
| V HP/100 FPM/in (vi) | 19.6 | 16.36 | 13.09 | 9.82 | 6.55 | 4.91 |
| U = V × W HP.100 FPM | 1414 | 982 | 628 | 353 | 157 | 88 |
| K = 2000,000 lb/in | | | | | | |
| δ max. in (v) | .024 | .020 | .016 | .012 | .008 | .006 |
| V HP/100 FPM/in (vi) | 14.6 | 12.1 | 9.7 | 7.3 | 4.8 | 3.7 |

In the case of the mill of subject invention, the corresponding figures can also be tabulated. In this case, it is necessary to modify some of the equations as follows (other equations remain unchanged):

$$W = D0 \quad \text{(viia)}$$

$$RSF = 1500D0^2/W \quad \text{(viiia)}$$

$$D1 = D0/3 \quad \text{(ixa)}$$

$$U\,\text{Max} = 6D1^2 \quad \text{(xa)}$$

where

D0 = diameter of back-up roll 23 (FIG. 1)

D1 = diameter of intermediate roll 27 (FIG. 1)

D2 = diameter of work roll 30 (FIG. 1)

It is also necessary to define the diameter of the work roll which is required in order to enable side support assemblies (side intermediate rolls 28, 29 and side backing rollers 21, 22, 25 and 26, FIG. 1) to be just large enough to support the torque reaction forces without exceeding side backing roller bearing capacities.

In copending application Ser. No. 006,804 of Jan. 26, 1979, we showed how the minimum work diameter could be calculated to satisfy this condition, and we also showed a method of calculating the corresponding sizes of said side intermediate rolls and side backing rollers.

We have now established, by further research, that the minimum required work roll diameter, for a given intermediate roll diameter and specific rolling power, in order to satisfy the above condition is given by the empirical formula:

$$D2_{(min.)} = \frac{D1}{10} \times e^{\left[\frac{LN(10V/D1)-.13539}{2.1614}\right]} \quad \text{(xi)}$$

The basic capability of the mill of subject invention can now be tabulated as follows:

TABLE 2

| | | | | | | |
|---|---|---|---|---|---|---|
| Strip Width (in) | 72 | 60 | 48 | 36 | 24 | 18 |
| D0 in. (viia) | 72 | 60 | 48 | 36 | 24 | 18 |
| D1 in. (ixa) | 24 | 20 | 16 | 12 | 8 | 6 |
| Max. RSF × 1000 lb/in (viii) | 108 | 90 | 72 | 54 | 36 | 27 |
| U max. (HP/100 FPM) (x) | 3456 | 2400 | 1536 | 864 | 384 | 216 |
| V max = U max/W(HP/100 FPM/in) | 48 | 40 | 32 | 24 | 16 | 12 |
| D2(min)in (xi) | 9.0 | 7.5 | 6.0 | 4.5 | 3.0 | 2.25 |
| K = 170,000 lb/in$^2$ | | | | | | |
| δ max. in (v) | .090 | .075 | .060 | .045 | .030 | .0225 |
| V (HP/100 FPM/in) (vi) | 46.2 | 38.5 | 30.8 | 23.1 | 15.1 | 11.5 |
| U = V × W (HP/100 FPM) | 3326 | 2310 | 1478 | 832 | 369 | 208 |
| K = 200,000 lb/in$^2$ | | | | | | |
| δ max. in (v) | .065 | .054 | .043 | .032 | .022 | .016 |
| V (HP/100 FPM/in) (vi) | 39.3 | 32.7 | 26.2 | 19.6 | 13.1 | 9.8 |
| U = V × W (HP/100 FPM) | 2828 | 1964 | 1256 | 707 | 314 | 177 |

Note that for material hardnesses less than 170,000 lb/in$^2$ the maximum reduction does not increase as the hardness reduces, but remains at D2/100. (i) However, the power decreases in proportion to the reduction in material hardness below 170,000 lb/in$^2$.

In Table 2 it can be seen that the minimum work roll diameter D2 (min) is about 37.5% of the intermediate (drive) roll diameter D1. In this case the mill is optimized for a material hardness of 170,000 lb/in$^2$ since, in this case only, the maximum reduction is achieved while full RSF and virtually full power are developed in the mill. For softer materials, with the maximum reduction of δmax=D2/100, neither maximum RSF nor maximum power are developed, since both of these reduce in proportion to material hardness. (see (ii) and (iii)) For rolling softer materials the work roll diameter can be increased to any desired value, an upper limit of D2=0.6D1 being envisaged. Table 2 can be extended for this limiting case.

TABLE 2 (continued)

| | | | | | | |
|---|---|---|---|---|---|---|
| Strip Width (in) | 72 | 60 | 48 | 36 | 24 | 18 |
| D2 (Max) in (.6D1) | 14.4 | 12 | 9.6 | 7.2 | 4.8 | 3.6 |
| K = 106,000 lb/in$^2$ | | | | | | |
| δ max. in (v) | .144 | .12 | .096 | .072 | .048 | .036 |
| V(HP/100 FPM/in) (vi) | 46.3 | 38.6 | 30.9 | 23.2 | 15.4 | 11.6 |
| U = V × W(HP/100 FPM) | 3334 | 2315 | 1482 | 834 | 370 | 208 |
| K = 134,000 lb/in$^2$ | | | | | | |
| δ max. in (v) | .090 | .075 | .060 | .045 | .030 | .023 |
| V(HP/100 FPM/in) (vi) | 36.6 | 30.5 | 24.4 | 18.3 | 12.2 | 9.2 |
| U = V × W(HP/100 FPM) | 2637 | 1832 | 1172 | 660 | 293 | 165 |
| K = 200,000 lb/in$^2$ | | | | | | |
| δ max. in (v) | .041 | .034 | .027 | .020 | .014 | .010 |
| V (HP/100 FPM/in) (vi) | 24.8 | 20.6 | 16.4 | 12.1 | 8.5 | 6.1 |
| U = V × W(HP/100 FPM) | 1789 | 1236 | 785 | 436 | 204 | 109 |

It can be seen from Table 2 that, for material hardnesses below 134,000 lb/in$^2$ the maximum work roll gives larger maximum reductions than the minimum work roll, but for material hardness greater than 134,000 lb/in$^2$ the reverse is true.

Clearly with the mill of subject invention, a work roll size can be selected within the above ranges to give best results with the material to be rolled in any particular case.

By comparison of Table 1 with Table 2, the following conclusions can be drawn:

(A) With materials having a hardness of less than about 100,000 lb/in$^2$ the four-high mill can provide greater reductions than the mill of present invention. However, in practice, very large reductions are rarely required when cold rolling these (softer) materials, since, being relatively soft also at high temperature, they are normally hot rolled to lighter gauges than the harder materials. For example, the starting thickness for cold rolling 48 in. wide low carbon steel (for which K=80,000 lb/in$^2$ approx.) is normally 0.10 in. maximum, and a reduction of more than about 35% of this, or 0.035 in., would seldom be required.

(B) With materials having a hardness of over 100,000 lb/in$^2$ the mill of present invention can provide higher reductions than a four high mill of similar size, the advantage becoming more marked for harder materials.

Because the mill of subject invention can use a smaller work roll than a four high mill, it develops a lower separating force, and this usually enables a smaller mill to be used for a given duty. As an example of this consider the typical cases of rolling of materials 48 in. wide, with hardness K in the range 50,000 to 200,000 lb/in$^2$ and with required maximum reductions as shown in Table 3.

TABLE 3

| | | | | |
|---|---|---|---|---|
| Four-High Mill | | | | |
| Material Hardness K × 1000 lb/in$^2$ | 50 | 100 | 150 | 200 |
| δ max (nominal) in | .05 | .04 | .03 | .025 |
| Back-up roll dia. in. | 32 | 42 | 48 | 54 |
| Max RSF (viii) × 1000 lb/in | 32 | 55.125 | 72 | 91.125 |
| Work roll dia. in. | 16 | 16 | 16 | 16 |
| Max. reduction (v) in. | .051 | .038 | .029 | .026 |
| V (vi) (HP/100 FPM/in) | 7.76 | 11.5 | 13.1 | 15.7 |
| Power U = V × W HP/100 FPM | 372 | 552 | 628 | 755 |
| Mill power rating max (x) HP/100 FPM | 1536 | → | → | → |
| Eighteen-High Mill | | | | |
| Back-up roll dia. D0 in | 24 | 32 | 36 | 42 |
| Max. allowable RSF (viiia) × 1000 lb/in | 18 | 32 | 40.5 | 55.125 |
| Intermediate roll dia. D1 (ixa) | 16 | 16 | 16 | 16 |
| D2 (xi) (or up to .6D1) | 5 | 5 | 5 | 6 |
| Max. reduction (v) in. | .050 | .041 | .029 | .025 |
| V (vi) | 7.58 | 12.4 | 13.3 | 15.3 |
| Power U = V × W HP/100 FPM | 364 | 596 | 636 | 737 |
| Mill power rating U max. (x) HP/100 FPM | 1536 | → | → | → |

From Table 3 it can be seen that, for a given duty, a smaller mill can be used for the mill of subject invention than is the case for a four-high mill regardless of material hardness. It also follows that, for a given back-up roll diameter (which is the main parameter governing mill size) our mill can be designed to roll wider strip than is the case with a four-high mill. It is foreseen that in general, the cost savings obtained from the general reduction in mill size will more than offset the cost of the extra components which our mill has relative to the four-high mill.

Note that, as can be seen from equn. (xi) and tables 2 and 3, the ratio of work roll size to intermediate roll size depends upon the required drive torque, and may vary from 30% to 60%.

Another advantage of our mill relative to the four-high mill is that it is possible to roll a given material to a much lighter gauge, the reduction in minimum gauge being substantially proportional to the reduction in work roll diameter.

Figure 6:
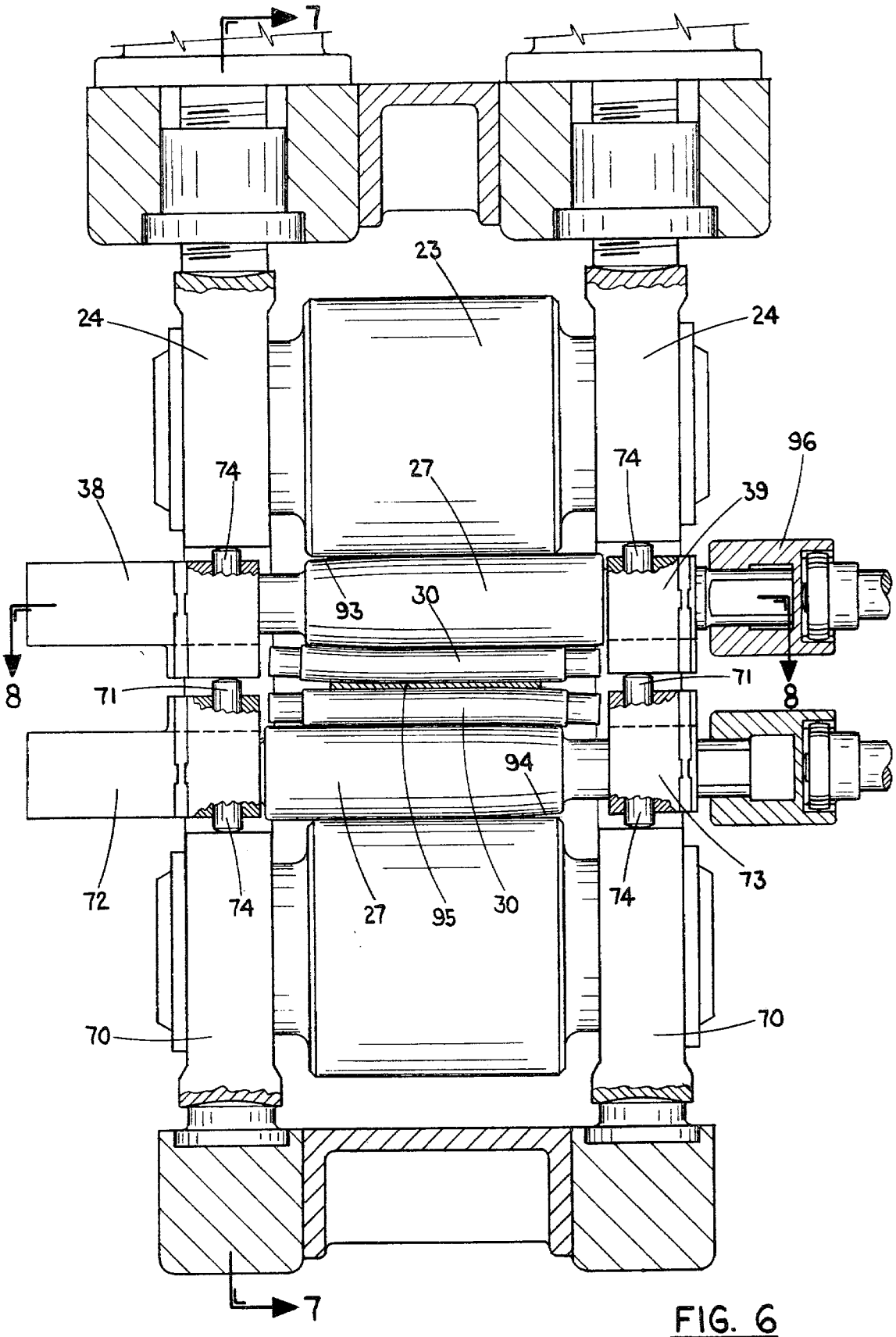
FIG. 6 is a view partially in section taken along the line 6—6 of FIGS. 2 and 7 showing the parabolic reliefs on intermediate roll ends and arrangement of axial adjustment mechanism.
Figure 7:
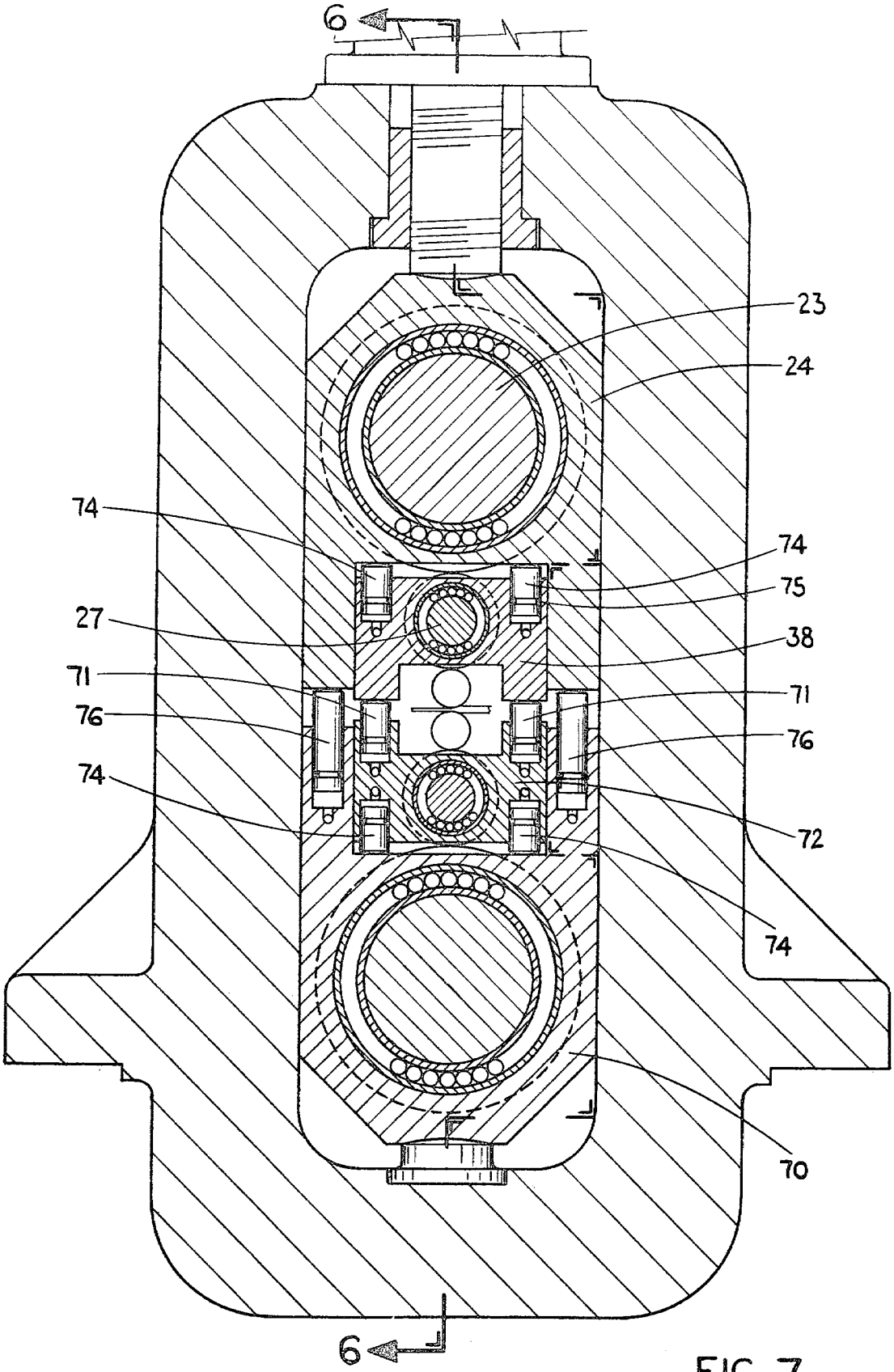
FIG. 7 is a sectional view taken along the line 7—7 of FIG. 6 showing the method of applying bending forces to the ends of the rolls.

Our mill incorporates an improved method of profiling and axially adjusting the intermediate rolls in order to provide the correct mill profile for a range of strip widths, and to provide a further improvement in profile control, means is provided to apply bending moments to the ends of the intermediate rolls. As shown in FIGS. 6 and 7 hydraulic rams 71 are mounted in the lower intermediate roll chocks 72 and 73 and thrust against the upper intermediate roll chocks 38 and 39. Actuation of said rams (under adjustable constant pressure control) applies a bending moment which bends the ends of intermediate rolls 27 away from the strip, thus relieving the rolling pressure on the strip edges. A second set of hydraulic rams 74 are provided in intermediate roll chocks 38, 39, 72 and 73. Said rams thrust against back-up roll chocks 24 and 70 as hydraulic oil is supplied to rams 74 through suitable supply holes. Seals 75 prevent oil leakage. Actuation of said rams (under adjustable constant pressure control) applies a bending moment which bends the ends of said intermediate rolls towards the strip, thus increasing the rolling pressure on the strip edges. Thus more or less crown can be put into the mill according to the direction of bending of the intermediate rolls.

Four hydraulic rams 76 are provided in lower back-up roll chocks 70 and thrust against upper back-up roll chocks 24 for the purpose of balancing the upper back-up roll assembly, according to the prior art.

The prior art method of shaping the roll ends on axially adjustable intermediate rolls is by conical taper. (Sendzimir, U.S. Pat. No. 2,776,580) where the start of the taper is positioned just inside the strip edge. Although this method has been very successful and even copied by others, we have found that, particularly for the less ductile materials, incorrect adjustment can result in local fractures in the rolled material at points in the material close to the strip edge, at points in the material corresponding to the location of the start of the taper. Furthermore, our researches on the subject of roll deformation indicate that the deflected form of the work roll adjacent to the strip edge is parabolic. Therefore in our new mill we incorporate a parabolic relief (in place of the conical taper) to provide the correct profile corresponding to the deflected form of the work roll, and to eliminate the tendency for fractures in rolled material caused by the sudden change from cylindrical to tapered sections in the intermediate roll at the start of the taper. Of course, in practice it may be necessary to approximate the parabolic relief due to limitations in roll grinding equipment. Common approximations would be circular arc relief and sine wave relief.

Note that, in FIG. 6 the relatively slender work rolls 30, which are normally straight, are shown flexing under the action of the roll separating force to follow the contour of the intermediate rolls 27. It can readily be visualized how both axial adjustment, and bending the ends, of said intermediate rolls will affect the profile of the strip 95 being rolled by the mill.

Figure 8:
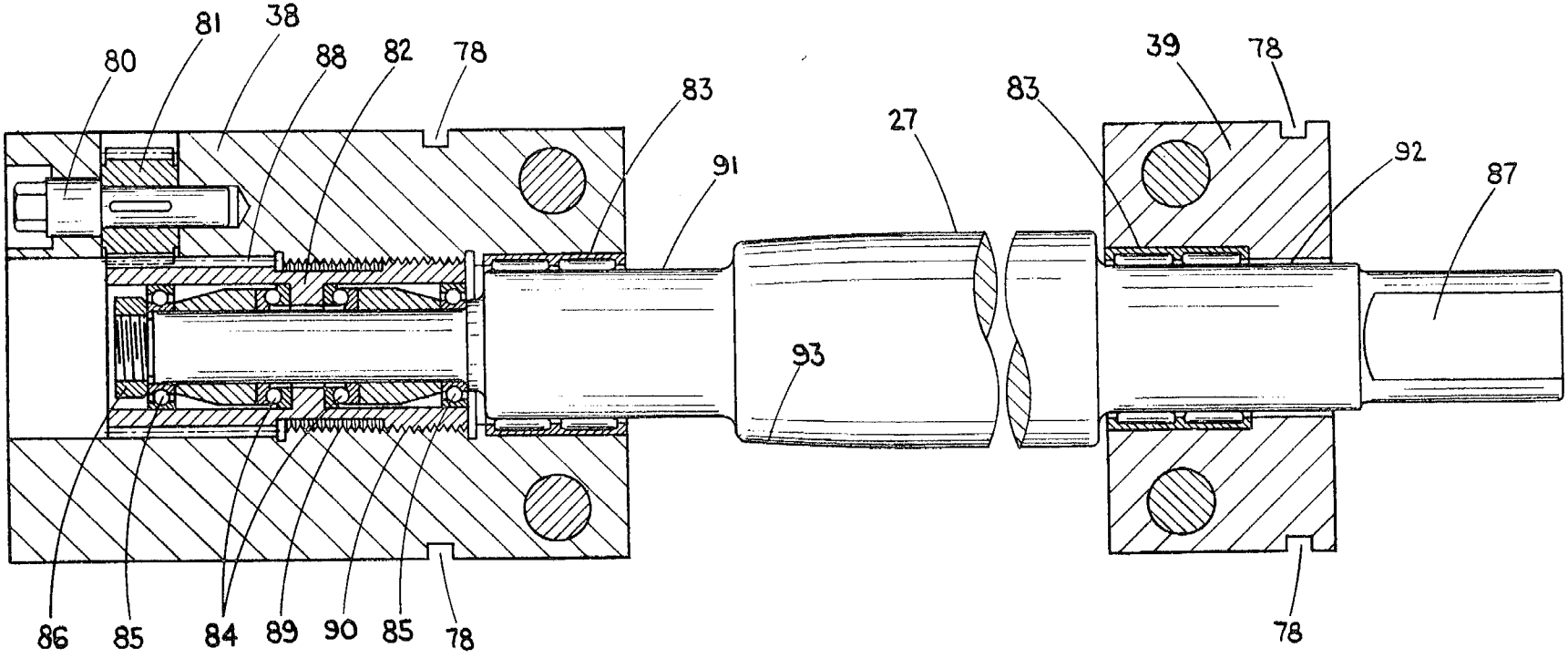
FIG. 8 is a plan sectional view along the line 8—8 of FIG. 6 showing the construction of the intermediate roll axial displacement mechanism.

We have also found that prior art methods of axially adjusting rolls are rather complicated and expensive. We therefore propose a new and simpler method where the adjustment mechanism is mounted in the intermediate roll chocks. One embodiment of this is shown in FIGS. 6 and 8, for the upper intermediate roll adjustment. In this embodiment a wrench is used by the mill operator to rotate shaft 80 on which pinion 81 is keyed. Said pinion engages with gear teeth 88 which have been machined into cartridge 82, thus rotating said cartridge which also moves axially as it screws in or out of chock 38 which is provided with screw threads 89 engaging with screw threads 90 in said cartridge. Intermediate roll 27 is free to rotate within said chock by means of radial bearing 83, and is located axially by means of thrust bearings 84, which locate it within cartridge 82. Radial bearings 85 ensure that said cartridge and the neck of said intermediate roll stay concentric, and nut 86, screwed on to the end of said intermediate roll, retains the roll neck within the cartridge. Thus, as the cartridge translates axially due to rotation of pinion 81, said intermediate roll is caused to translate axially also. Said intermediate roll is provided with extra long driving flats 87 enabling it to slide in and out of drive coupling 96 while full drive torque is being transmitted, during the axial adjustment time. Similarly extra long journals 91 and 92 are provided on said intermediate roll to enable said intermediate roll to move axially relative to bearings 83. Parabolic relief 93 is provided on upper intermediate roll 27 at one end, and a similar relief 94 is provided at the opposite end of the lower intermediate roll. Keeper plates 77 mounted on back-up roll chocks 24 (FIG. 2) engage with slots 78 in intermediate roll chocks 38 and 39 to locate said chocks axially.

In the embodiment shown, the arrangement for axially adjusting said lower intermediate roll is identical to the arrangement just described for adjusting said upper intermediate roll. Control of the strip profile adjacent to one edge is afforded by the upper intermediate roll adjustment, and control of said profile adjacent to the other edge is afforded by the lower intermediate roll adjustment. In another embodiment of the intermediate roll axial adjustment device, pinion shaft 80 is rotated by a hydraulic motor, enabling remote operation.

In the same way that the parabolic reliefs on the intermediate rolls can be used to compensate for the deflected form of the work rolls adjacent to the strip edge, the bending of the intermediate rolls is used to compensate for the deflected form of the intermediate rolls. Said bending can also be used to shape the mill to suit the profile of the incoming strip.

This combination of axial adjustment and bending of the intermediate rolls enables the mill profile to be adjusted to suit a wide variety of rolling conditions.

The embodiments of the invention in which an exclusive property or privilege is claimed are defined as follows:

1. An eighteen-high rolling mill roll arrangement, consisting of an upper and lower nine-roll cluster, each of said clusters consisting of a work roll, intermediate roll and back-up roll arranged in the same vertical plane, two side intermediate rolls, one contacting each side of said work roll, and with each of said side intermediate rolls being contacted by two side back-up rolls.

2. A rolling mill with a roll arrangement as in claim 1 where, for each cluster, the intermediate roll and back-up roll are mounted in chocks, the work roll and side intermediate rolls float freely in said cluster, and the side back-up rolls each consist of several rollers rotatably mounted upon stationary shafts, said shafts being mounted in, and supported at intervals throughout their length, by an adjustable stationary rigid support beam.

3. In a six-high (1-1-1) rolling mill arrangement, the improvement consisting of lateral support roller assemblies mounted on each side of each work roll, said assemblies, by preventing lateral bending of the work rolls under the action of the drive torque reaction forces, enable smaller size work rolls to be adopted, and wherein each of said assemblies consists of an intermediate roll which is itself fully supported throughout its length in both vertical and horizontal planes by two backing roller assemblies, each of said backing roller assemblies consisting of several rollers rotatably mounted upon stationary shafts, said shafts being mounted in and supported at intervals throughout their length by an adjustable stationary rigid support beam.

4. A mill according to claim 1, with driven intermediate rolls and in which back-up roll and intermediate roll proportions are respectively similar to back-up roll and work roll proportions on four-high mills, and in which the work roll diameter is between 30% and 60% of the intermediate roll diameter.

5. A mill according to claim 1 in which mill profile is controlled by axially adjustable intermediate rolls, where the drives for axial adjustment of said intermediate rolls are mounted within the intermediate roll chocks.

* * * * *